US007518621B2

(12) United States Patent
Kinoshita et al.

(10) Patent No.: US 7,518,621 B2
(45) Date of Patent: Apr. 14, 2009

(54) METHOD OF CORRECTING UNEVEN DISPLAY

(75) Inventors: Atsushi Kinoshita, Osaka (JP); Susumu Tanase, Kadoma (JP); Yukio Mori, Hirakata (JP); Atsuhiro Yamashita, Osaka (JP); Masutaka Inoue, Neyagawa (JP); Shigeo Kinoshita, Mizuho (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 525 days.

(21) Appl. No.: 10/551,223

(22) PCT Filed: Mar. 26, 2004

(86) PCT No.: PCT/JP2004/004363

§ 371 (c)(1),
(2), (4) Date: Sep. 27, 2005

(87) PCT Pub. No.: WO2004/086345

PCT Pub. Date: Oct. 7, 2004

(65) Prior Publication Data

US 2006/0214940 A1 Sep. 28, 2006

(30) Foreign Application Priority Data

Mar. 27, 2003 (JP) ..... 2003-088216

(51) Int. Cl.
*G09G 5/10* (2006.01)
*G09G 3/36* (2006.01)

(52) U.S. Cl. ..... 345/690; 345/87; 345/204; 345/694; 345/698

(58) Field of Classification Search ..... 345/55, 345/76, 77, 82, 83, 84, 87, 88, 89, 204, 690, 345/694, 698
See application file for complete search history.

(56) References Cited

U.S. PATENT DOCUMENTS

| | | | | |
|---|---|---|---|---|
| 6,850,214 | B2 * | 2/2005 | Nishitani et al. | 345/87 |
| 7,126,563 | B2 * | 10/2006 | Lin et al. | 345/63 |
| 7,170,535 | B2 * | 1/2007 | Matsuda | 345/690 |
| 7,345,660 | B2 * | 3/2008 | Mizukoshi et al. | 345/77 |
| 2001/0015835 | A1 | 8/2001 | Aoki | |
| 2002/0047550 | A1 | 4/2002 | Tanada | |

FOREIGN PATENT DOCUMENTS

| | | |
|---|---|---|
| JP | 11-352920 | 12/1999 |
| JP | 2001-343954 | 12/2001 |
| JP | 2002-169511 | 6/2002 |

OTHER PUBLICATIONS

Translation of the International Preliminary Report on Patentability of International Application No. PCT/JP 2004/004363, with Form PCT/IPEA/409.

* cited by examiner

*Primary Examiner*—My-Chau T Tran
(74) *Attorney, Agent, or Firm*—Westerman, Hattori, Daniels & Adrian, LLP.

(57) ABSTRACT

An uneven display correction method including a first step of dividing a display area of a display panel into a plurality of unit areas, the first step setting one arbitrary unit area among the unit areas at a reference area, the first step previously determining a value as a correction parameter in each unit area, the value corresponding to a difference between a light-emission start gradation level of the unit area and the light-emission start gradation level of the reference area; and a second step of correcting an input video signal based on the correction parameter determined in each unit area.

16 Claims, 14 Drawing Sheets

FIG. 6

| | | |
|---|---|---|
| A | B | C |
| D | E | F |

FIG. 7

| | | |
|---|---|---|
| 100 | 80 | 75 |
| 95 | 80 | 70 |

| | | |
|---|---|---|
| 100 | 80 | 75 |
| 95 | 80 | 70 |

(a) Yin=127

| | | |
|---|---|---|
| 357 | 286 | 268 |
| 339 | 286 | 250 |

(b) Yin=255

METHOD OF CORRECTING UNEVEN DISPLAY

TECHNICAL FIELD

The present invention relates to a method of correcting uneven display in display panels such as an organic EL panel.

BACKGROUND ART

In the display panels such as the organic EL panel, currently it is difficult that a brightness characteristic is equalized over the whole areas, and generation of the uneven display becomes a serious problem. A fluctuation in film thickness of a light-emission layer in a display panel production process can be cited as an example of the cause for the generation of the uneven display.

In one of the conventional methods of correcting the uneven display, uneven display correction parameters for all the gradation levels are previously prepared in each pixel, and an input signal is corrected based on the uneven display correction parameter. In the above conventional method, it is necessary that the uneven display correction parameters for all the gradation levels are prepared in each pixel.

The inventor discovered that the fluctuation in threshold voltage (Vth) of a thin film transistor (TFT) in the organic EL panel causes the uneven display.

The invention notices that the fluctuation in threshold voltage of the thin film transistor (TFT) causes the uneven display. An object of the invention is to provide an uneven display correction method in which the uneven display is corrected to improve brightness evenness with the smaller number of parameters by correcting the input signal in order to modify the fluctuation in light-emission start gradation level among the pixels

DISCLOSURE OF THE INVENTION

A first uneven display correction method according to the invention, characterized by including a first step of dividing a display area of a display panel into a plurality of unit areas, the first step setting one arbitrary unit area among the unit areas at a reference area, the first step previously determining a value as a correction parameter in each unit area, the value corresponding to a difference between a light-emission start gradation level of the unit area and the light-emission start gradation level of the reference area; and a second step of correcting an input video signal based on the correction parameter determined in each unit area wherein the first step includes an a step of dividing a display area of a display panel into a plurality of unit areas; a b step of measuring brightness of each unit area in one predetermined gradation level; a c step of determining a light-emission efficiency characteristic (gamma characteristic) in an arbitrary unit area; and a d step of computing the value as the correction parameter in each unit area by setting one arbitrary unit area among the unit areas at the reference area based on the brightness measured in each unit area in the b step and the light-emission efficiency characteristic determined in the c step, the value corresponding to the difference between the light-emission start gradation level of the unit area and the light-emission start gradation level of the reference area.

In the b step, for example, the brightness of each unit area is measured with a surface brightness measuring apparatus. In the b step, the brightness of each unit area is measured by measuring current passing through the display panel.

Each unit area may be an area of one pixel unit, or each unit area may be an area having a predetermined size including a plurality of pixels. Each unit area may be a divided area which is obtained by dividing the display area of the display panel into a plurality of display areas in a laser annealing position moving direction during a display panel producing process. Each unit area may be a divided area which is obtained by dividing the display area of the display panel into the plurality of display areas in a direction orthogonal to the laser annealing position moving direction while dividing the display area of the display panel into the plurality of display areas in the laser annealing position moving direction during the display panel producing process.

In the case where each unit area is an area of one pixel unit, the second step corrects, for example, the input video signal based on the correction parameter according to a pixel position of the input video signal. In the case where each unit area is an area having a predetermined size including a plurality of pixels, the second step includes, for example, a step of determining the correction parameter according to the pixel position of the input video signal by performing second-order linear interpolation on the correction parameters of four unit areas near the pixel position of the input video signal; and a step of correcting the input video signal based on the correction parameter according to the pixel position of the input video signal.

The unit area corresponding to the highest brightness in the brightness measured in the b step is determined as a reference unit area, and the uneven display correction method includes a fourth step of allocating the number of input video signal levels to the number of gradation levels in which a correction parameter maximum value is subtracted from the whole number of gradation levels while the correction parameter determined in the d step is set at the correction parameter maximum value for the unit area corresponding to the lowest brightness in the brightness measured in the b step, and the second step may be performed after the fourth step.

A second uneven display correction method according to the invention, characterized by including a first step of dividing a display area of a display panel into a plurality of unit areas, the first step setting one arbitrary unit area among the unit areas at a reference area, the first step previously determining a value as a correction parameter in each unit area, the value corresponding to a difference between a light-emission start gradation level of the unit area and the light-emission start gradation level of the reference area; and a second step of correcting an input video signal based on the correction parameter determined in each unit area, wherein the first step includes a step of determining an adjustment value for adjusting a black reference voltage such that the light-emission start gradation level of the reference area becomes a zero level except that the light-emission start gradation level is the zero level and a step of previously determining a value as the correction parameter in each unit area after the light-emission start gradation level of the unit area is substituted for the light-emission start gradation level of the each unit area of the post-black reference voltage adjustment, the value corresponding to the difference between the light-emission start gradation level of the unit area and the light-emission start gradation level of the reference area.

In the second uneven display correction method, the first step includes, for example, an e step of dividing a display area of a display panel into a plurality of unit areas; an f step of measuring brightness of each unit area in two predetermined gradation levels different from each other; a g step of determining a light-emission efficiency characteristic in an arbitrary unit area; an h step of setting one arbitrary unit area in the unit areas at a reference area, the h step determining an adjustment value for adjusting the black reference voltage such that the light-emission start gradation level of the reference area becomes a zero level based on two values of the brightness and the light-emission efficiency characteristic, the two values of the brightness being measured in two gradation levels previously determined with respect the reference area in the f step, the light-emission efficiency characteristic being determined in the g step; and an i step of computing a value as the correction parameter in each unit area based on the brightness measured in each unit area in the f step, the light-emission efficiency characteristic determined in the g step, and the adjustment value determined in the h step, the value corresponding to the difference between the light-emission start gradation level of the unit area and the light-emission start gradation level of the reference area.

The unit area corresponding to the highest brightness is determined as a reference unit area in the brightness measured in the f step, and the first uneven display correction method includes a fifth step of allocating the number of input video signal levels to the number of gradation levels in which a correction parameter maximum value is subtracted from the whole number of gradation levels while the correction parameter determined in the i step is set at the correction parameter maximum value for the unit area corresponding to the lowest brightness in the brightness measured in the f step, and the second step may be performed after the fifth step.

A third uneven display correction method according to the invention, characterized by including a first step of dividing a display area of a display panel into a plurality of unit areas, the first step setting one arbitrary unit area among the unit areas at a reference area, the first step previously determining a correction parameter for approximately calculating a difference in input video signal for the same brightness between a light-emission efficiency characteristic for each input video signal level in the unit area and the light-emission efficiency characteristic for each input video signal level in the reference area in each unit area, with the use of the input video signal level as a variable; and a second step of correcting an input video signal based on the correction parameter determined in each unit area.

In the third uneven display correction method, the first step includes, for example, an a step of dividing a display area of a display panel into a plurality of unit areas; a b step of measuring brightness of each unit area in a first predetermined gradation level; a c step of measuring brightness of each unit area in a second predetermined gradation level; a d step of determining a light-emission efficiency characteristic in an arbitrary unit area; an e step of computing the difference in input video signal for the same brightness between the light-emission efficiency characteristic for each input video signal level in the unit area and the light-emission efficiency characteristic for each input video signal level in the reference area at the first gradation level in each unit area based on the brightness measured in each unit area in the b step and the light-emission efficiency characteristic determined in the d step; an f step of computing the difference in input video signal for the same brightness between the light-emission efficiency characteristic for each input video signal level in the unit area and the light-emission efficiency characteristic for each input video signal level in the reference area at the second gradation level in each unit area based on the brightness measured in each unit area in the c step and the light-emission efficiency characteristic determined in the d step; and a g step of determining the correction parameter based on the difference determined in each unit area in the e step and the difference determined in each unit area in the f step.

In the third uneven display correction method, the correction parameters are, for example, $\alpha$ and $\beta$ given by the following formula:

$$Vth=(\alpha\times Yin/Ymax)+\beta,$$

where Yin: input video signal level,

Ymax: maximum value of signal level in scope of input video signal, and

Vth: approximate value of difference in input video signal for the same brightness between light-emission brightness characteristics for each input video signal level in a certain unit area and for each input video signal level in reference area when input video signal level exists at Yin.

BRIEF DESCRIPTION OF THE DRAWINGS

FIG. 6 is a schematic view showing a state in which a display screen area on a display panel is divided into six areas A to F of 2×3;

FIG. 7 is a schematic view showing measurement results $L_A$ to $L_F$ of brightness in the area A to F;

BEST MODE FOR CARRYING OUT THE INVENTION

Preferred embodiments of the invention will be described below with reference to the accompanying drawings.

In the following descriptions, it is assumed that an input video signal is set at eight bits after post-analog-to-digital conversion. A voltage given to the display panel is referred to as input gradation level in terms of a value in 256 levels. A post-analog-to-digital conversion input video signal level is referred to as input video signal level, and the input video signal level is used in distinction from the input gradation level.

[A] Description of First Embodiment

[1] Description of Principle of Uneven Display Correction Method

Figure 1:
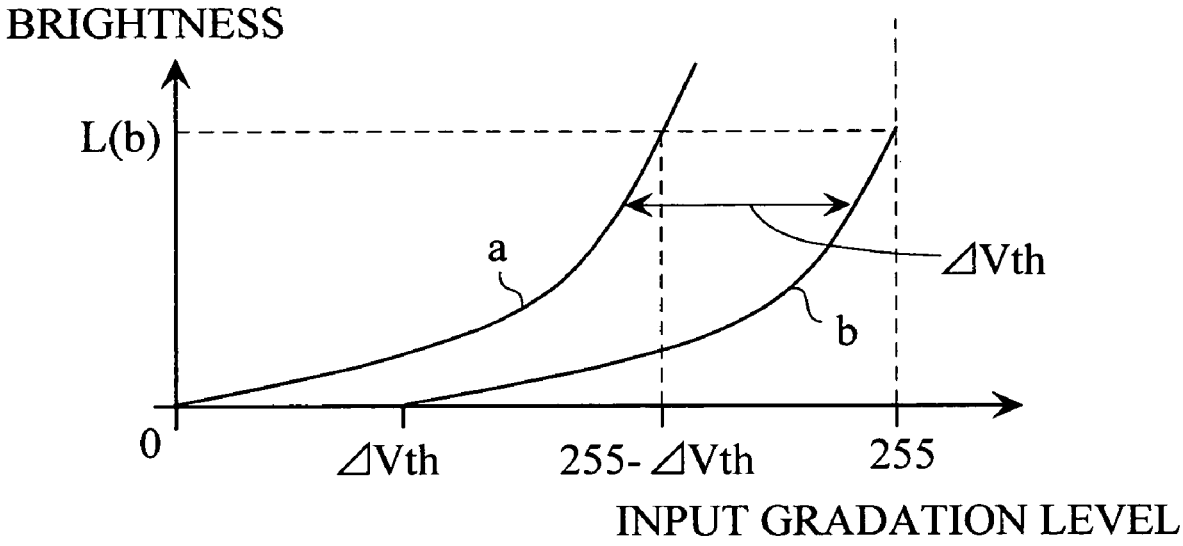
FIG. 1 is a graph showing input gradation level-brightness characteristics for pixels a and b.

It is assumed that input gradation level-brightness characteristics of pixels a and b whose display panels differ from each other have characteristics shown by a and b of FIG. 1. When the light light-emission start voltages Vth differ from each other in the pixels as shown in FIG. 1, the uneven display is generated.

The light-emission efficiency characteristics (gamma characteristics) themselves are substantially equal to one another among the pixels. Therefore, when the input video signal level brightness characteristic of one of the two pixels is horizontally shifted by a value corresponding to the difference ΔVth in light-emission start gradation levels Vth between the pixels, the input video signal level-brightness characteristics become equal to each other at positions of the pixels a and b, which allows the uneven display to be corrected.

Figure 2:
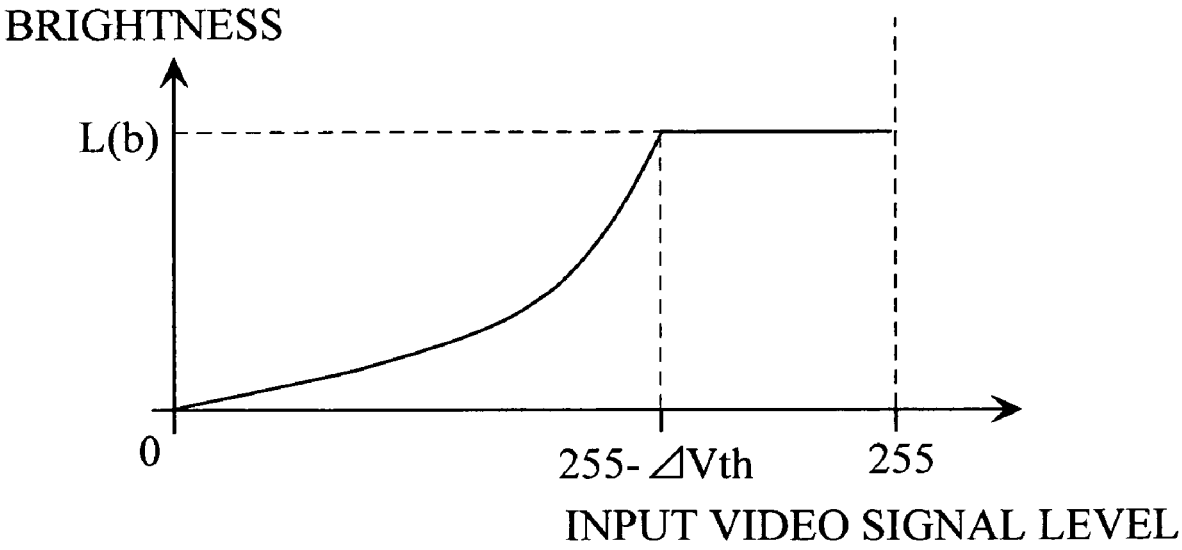
FIG. 2 is a graph showing the input video signal level-brightness characteristics when the input video signal level-brightness characteristics of the pixel b is shifted leftward by $\Delta$Vth by giving a value, in which $\Delta$Vth is added to an input video signal for the pixel b, to the pixel b.

For example, in an example of FIG. 1, a value in which ΔVth is added to the input video signal for the pixel b is given to the pixel b to shift the input video signal level-brightness characteristic of the pixel b leftward by ΔVth, which allows the input video signal level-brightness characteristics to be equalized to in the pixels a and b. FIG. 2 shows the input video signal level-brightness characteristic in the case where the input video signal level-brightness characteristic of the pixel b is shifted leftward by ΔVth.

However, because the display panel does not exert the brightness higher than the brightness corresponding to an input gradation level of "255," it is necessary that correction is performed such that the brightness in which input gradation of the darkest pixel (pixel having the highest light-emission start gradation level Vth) is "255" is set at an upper limit. In the above example, as shown in FIGS. 1 and 2, it is necessary that brightness L(b) in which the input gradation of the darkest pixel b is "255" is set at the upper limit in performing the correction. As a result, the brightness for the input video signal levels larger than (255−ΔVth) becomes a constant value (L(b)), and expression gradation is decreased by ΔVth.

Therefore, the input video signal levels from 0 to 255 are evenly allocated to the number of expression gradation levels after the shift process is performed to the input video signal of the darkest pixel. In the above example, letting ΔVth=30 leads to 226 steps (0 to 225) for the number of expression gradation levels after the shift process is performed to the input video signal of the darkest pixel. Accordingly, a level range from 0 to 255 of the input video signal for each pixel is evenly allocated to the steps of 0 to 225, and then the shift process is performed.

Figure 3:
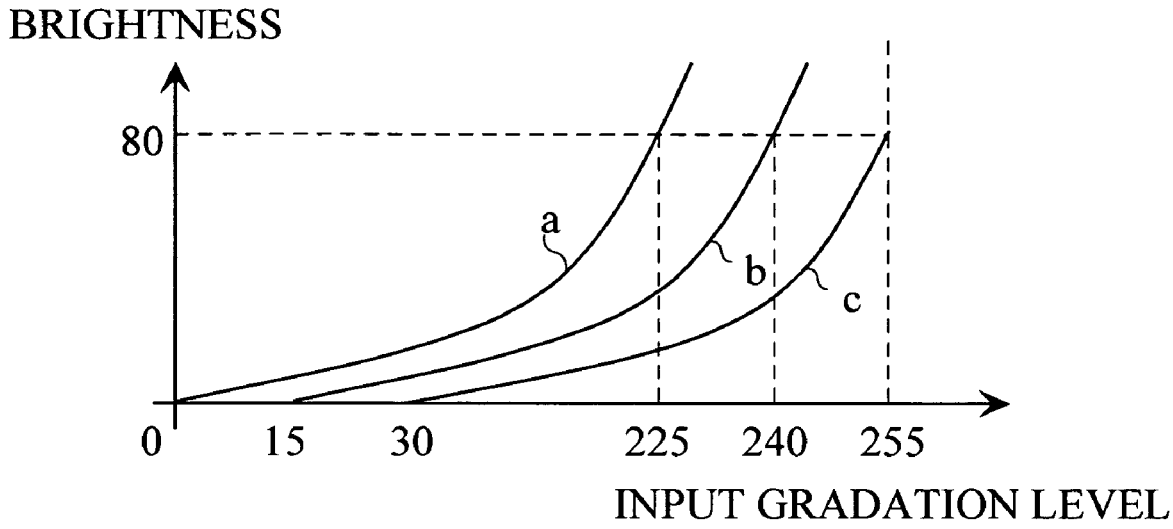
FIG. 3 is a graph showing input gradation level-brightness characteristics for pixels a, b, and c.

For example, as shown in FIG. 3, it is assumed that the input gradation level-brightness characteristics of the pixels a, b, and c whose display panels differ from one another are the characteristics a, b, and c shown in FIG. 3. When the characteristic a is set at a reference, it is assumed that a shift amount is determined at 15 for the input video signal of the pixel b and a shift amount is determined at 30 for the input video signal of the pixel c.

In this case, since the shift amount for the input video signal of the pixel c is largest, the level range of 0 to 255 of the input video signal for each pixel is evenly allocated to the number of expression gradation levels of 226 (0 to 225) after the shift process is performed to the input video signal of the pixel c.

That is, when (255−shift amount to darkest pixel)/255 is multiplied by the input video signal, the input video signal level becomes the range from 0 to 225 after the multiplication, which changes a step width of the input video signal. Hereinafter the above process is referred to as input video signal step width changing process. Then, the shift process is performed to the post-multiplication signal.

Since the shift amount is zero for the pixel a, the input gradation level ranges from 0 to 225 after the shift process. On the other hand, since the shift amount is 15 for the pixel b, the input gradation level ranges from 15 to 240 after the shift process. Further, the shift amount is 30 for the pixel c, the input gradation level ranges from 30 to 255 after the shift process.

Figure 4:
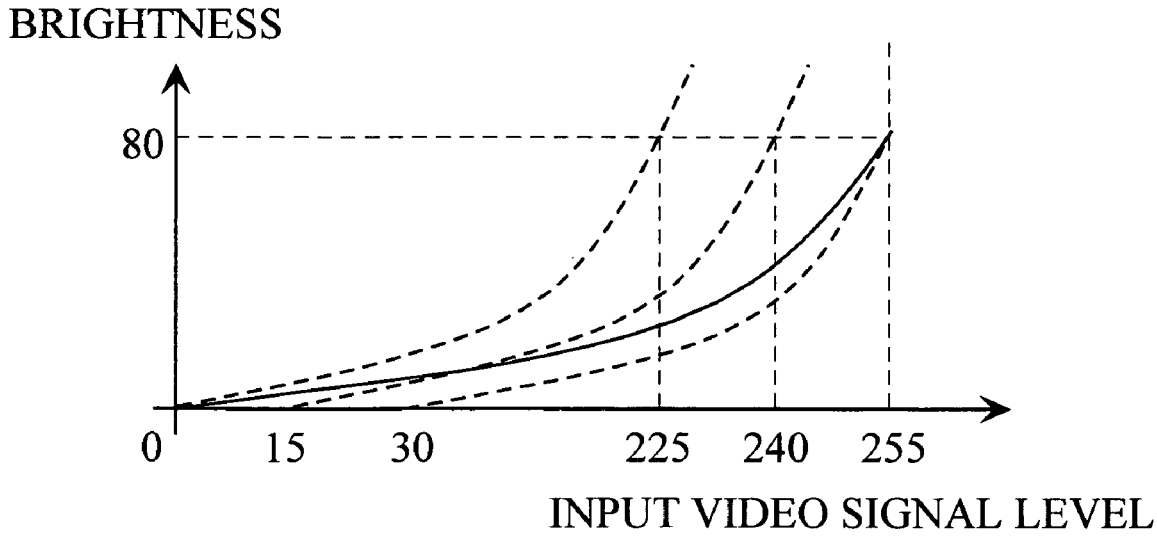
FIG. 4 is a graph showing the input video signal level-brightness characteristics when a step width changing process is performed before a shift process to the input video signal.

Accordingly, the brightness characteristic of the input video signal level (0 to 255) is obtained for the pixels a, b, and c as shown by a solid line in FIG. 4, so that the uneven display can be eliminated and the decrease in gradation is reduced on the high gradation level side when compared with FIG. 2.

Hereinafter the above shift amount is referred to as correction parameter. In the first embodiment, the correction parameter is not determined in each pixel, but a display screen area on the display panel is divided into plural areas to previously determine the correction parameter in each area. The correction parameter for each pixel is determined by performing linear interpolation to the correction parameters of four areas near the pixel during uneven display correction.

[2] Description of Correction Parameter Computing Method in Each Area

Figure 5:
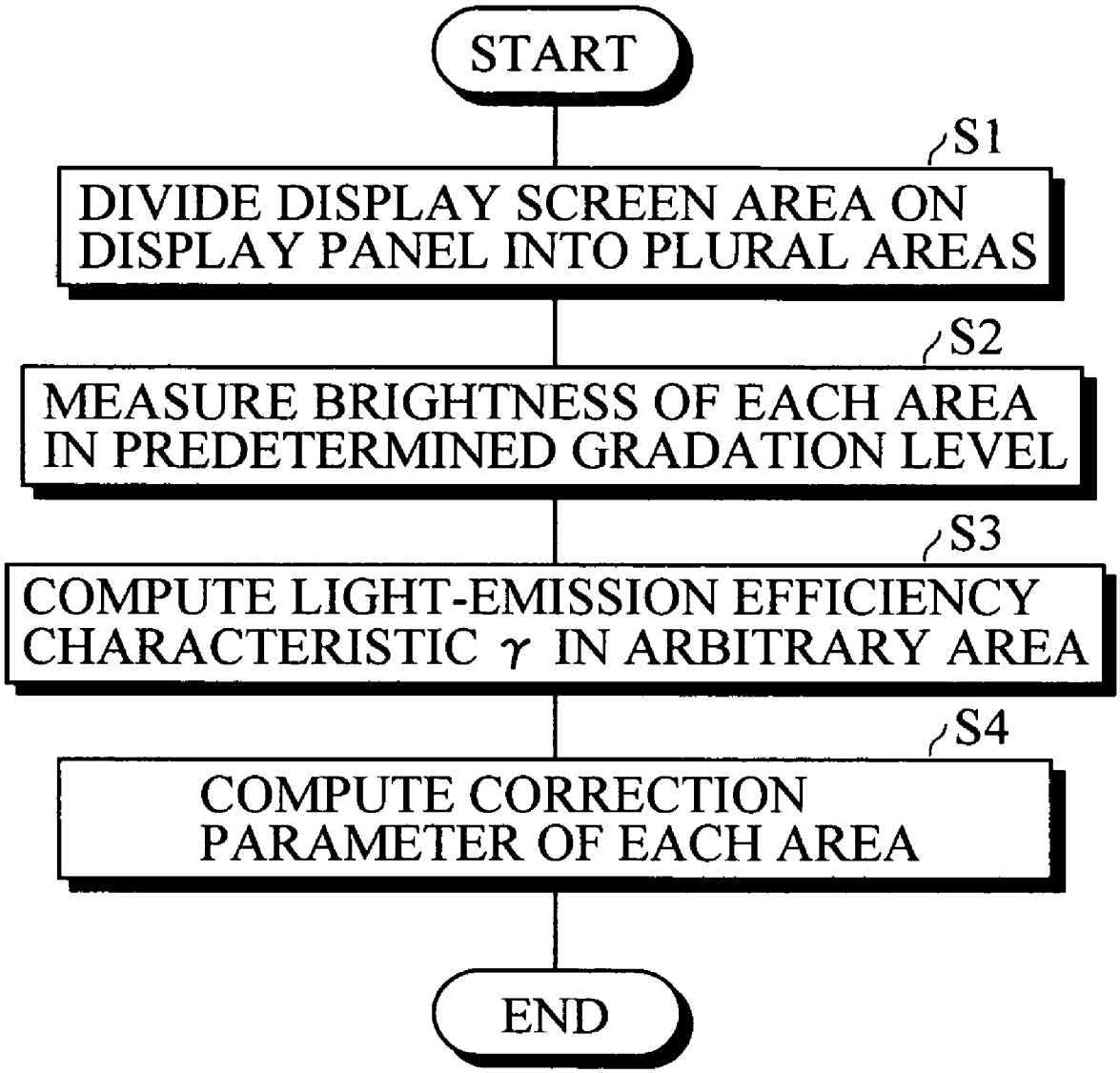
FIG. 5 is a flowchart showing a procedure of computing a correction parameter in each area.

FIG. 5 shows a procedure of computing the correction parameter in each area.

First the display screen area on the display panel is divided into the plural areas (Step S1). For example, as shown in FIG. 6, the display screen area on the display panel is divided into six areas A to F of 2×3. Actually it is preferable that the display screen area on the display panel is divided into more areas. However, for the sake of convenience, it is assumed that the display screen area on the display panel is divided here into six areas.

Then, in a predetermined gradation level (hereinafter referred to as brightness measurement gradation level, and set at "127" here), the brightness of each of the areas A to F is measured (Step S2). Specifically, the input video signal having the input gradation corresponding to the 127 level is inputted to all the pixels of the display panel, and the brightness of each of the areas A to F is measured with for example a surface brightness measuring apparatus.

Because current passing through the display panel is proportional to the brightness, the brightness of each of the areas A to F may be measured as follows. That is, only the area A of the display panel is lit, an integrated value of the whole current passing through the display panel is measured at that time, and the obtained integrated value is set at the brightness of the area A. Similarly, the brightness is measured in other areas B to F.

In this example, it is assumed that the brightness measurement results $L_A$ to $L_F$ of the areas A to F give the values shown in FIG. 7. That is, $L_A$=100, $L_B$=80, $L_C$=75, $L_D$=95, $L_E$=80, and $L_F$=70. The brightest area is the area A, and the darkest area is the area F.

Then, in an arbitrary area in the areas A to F, a light-emission efficiency characteristic γ is computed (Step S3). For example, the light-emission efficiency characteristic γ is computed in the area A. At this point, in the area A, the γ value may be computed by measuring the brightness in each plural gradation levels or the already-known γ value may be used.

When the γ value is computed by measuring the brightness in each plural gradation levels in the area A, the γ value is computed in each plural gradation levels based on the following formula (1). Then, for example, an average value of the obtained plural γ values is set at the γ value of the area A.

$$L = 100 \times \left(\frac{I}{127}\right)^{\gamma} \tag{1}$$

Where 127 is the brightness measurement gradation level, 100 is the bright at the brightness measurement gradation level, L is the brightness, and I is the input gradation.

Then, the correction parameter is computed in each of the areas A to F (Step S4).

When Vth(i), Data(i), Level, and γ are defined as follows, the correction parameters of the areas A to F is computed based on the following formula (2).

Vth(i): shift amount of area i from reference area ω (correction parameter)

Data(i): measurement brightness of area i in brightness measurement gradation level Data(ω): measurement brightness of reference area ω in brightness measurement gradation level Level: brightness measurement gradation level γ: light-emission efficiency characteristic (constant value) of display panel $$\mathrm{Data}(i) = \mathrm{Data}(\omega) \times \left(\frac{\mathrm{Level} - Vth(i)}{\mathrm{Level}}\right)^{\gamma} \tag{2}$$

At this point, the brightest area (area where measurement brightness is highest in the brightness measurement gradation level) is set at the reference area ω. Assuming that the reference area is area A, the number of brightness measurement gradation levels is "127," γ=2, and the measurement brightness of each of the areas A to F in the brightness measurement gradation level is the value shown in FIG. 7, the following formulas (3) to (8) hold from the formula (2) for the areas A to F respectively.

$$100 = 100 \times \left(\frac{127 - Vth(A)}{127}\right)^2 \tag{3}$$

-continued $$80 = 100 \times \left(\frac{127 - Vth(B)}{127}\right)^2 \tag{4}$$

$$75 = 100 \times \left(\frac{127 - Vth(C)}{127}\right)^2 \tag{5}$$

$$95 = 100 \times \left(\frac{127 - Vth(D)}{127}\right)^2 \tag{6}$$

$$80 = 100 \times \left(\frac{127 - Vth(E)}{127}\right)^2 \tag{7}$$

$$70 = 100 \times \left(\frac{127 - Vth(F)}{127}\right)^2 \tag{8}$$

The shift amounts Vth(i) of the areas A to F from the reference area A are computed based on the above formulas (3) to (8). The computation results are as follows:

Vth(A)=0
Vth(B)=13.4
Vth(C)=17.0
Vth(D)=3.2
Vth(E)=13.4
Vth(F)=20.7

[3] Description of Uneven Display Correction Circuit

Figure 8:
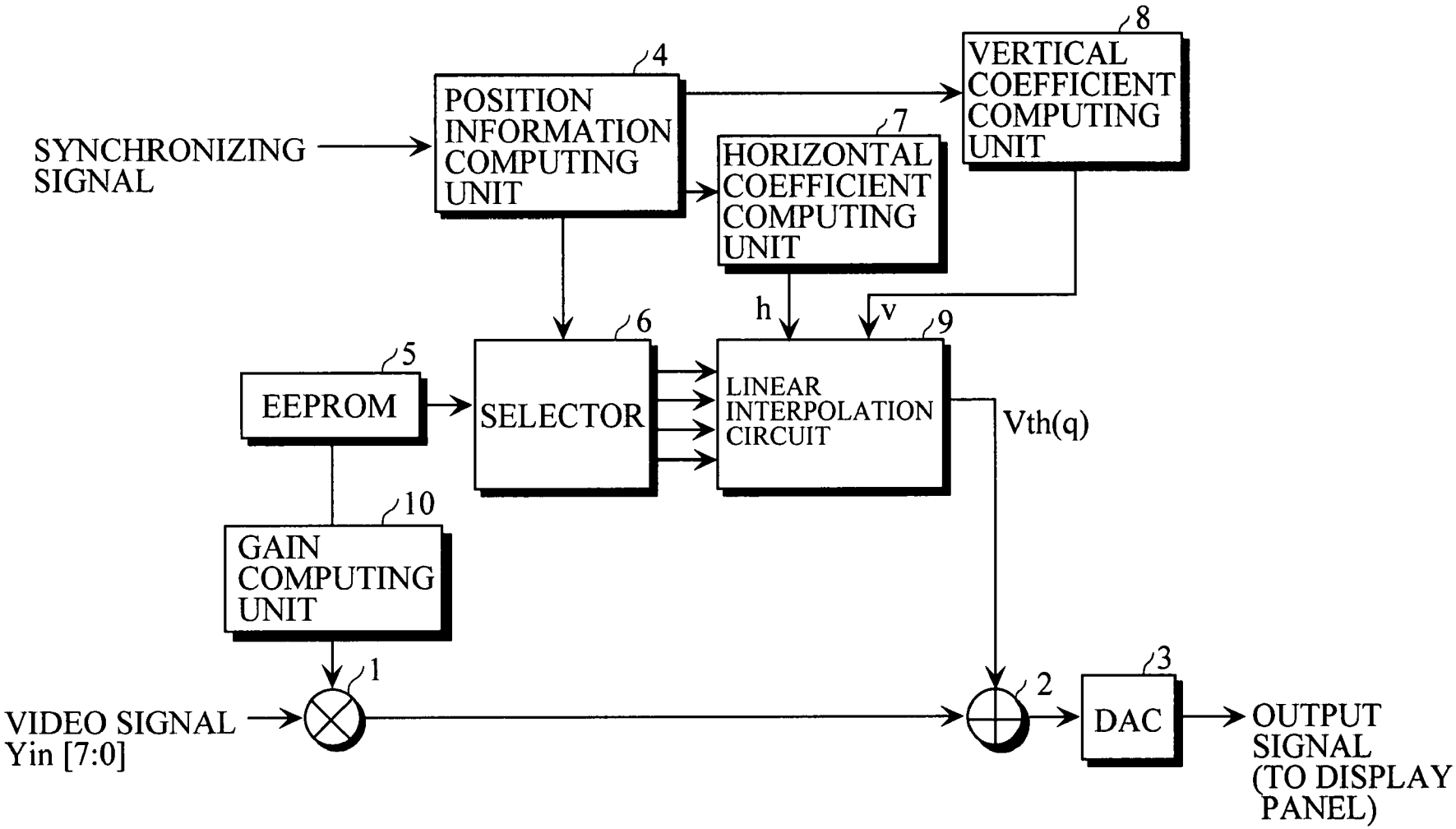
FIG. 8 is a block diagram showing a configuration of an uneven display correction circuit.

FIG. 8 shows the configuration of an uneven display correction circuit.

The correction parameters Vth(A) to Vth(F) of the areas A to F are stored in EEPROM 5. A maximum value $Vth_{MAX}$ of the correction parameter is also stored in EEPROM 5. The maximum value of the correction parameter becomes the correction parameter for the darkest area. In the above example, $Vth_{MAX}$=Vth(F)=20.7.

An input video signal Yin is transmitted to the display panel (organic EL panel) through a multiplier 1, an adder 2, and DAC 3. The multiplier 1 performs the process of changing the step width of the input video signal. The adder 2 performs the shift process to the output of the multiplier 1. DAC 3 converts the output of the adder 2 into an analog signal.

The maximum value $Vth_{MAX}$ of the correction parameter is transmitted from EEPROM 5 to a gain computing unit 10. The gain computing unit 10 computes a gain based on the following formula (9), and the gain computing unit 10 provides the computed gain to the multiplier 1.

$$\mathrm{gain} = 100 \times \frac{255 - Vth_{MAX}}{255} \tag{9}$$

A synchronizing signal included in the input video signal is transmitted to a position information computing unit 4. The position information computing unit 4 computes position information (xq, yq) of the currently inputted video signal (video signal of target signal) based on the synchronizing signal.

The position information (xq, yq) of the target pixel, which is computed by the position information computing unit 4, is transmitted to a selector 6, a horizontal coefficient computing unit 7, and a vertical coefficient computing unit 8. The correction parameters Vth(A) to Vth(F) corresponding to the areas A to F are inputted from EEPROM 5 to the selector 6. The selector 6 outputs the correction parameters corresponding to the four areas near the target pixel based on the position information (xq, yq) of the target pixel, which is transmitted from the position information computing unit 4. The correction parameters corresponding to the four areas, which are outputted from the selector 6, are transmitted to a linear interpolation circuit 9.

The horizontal coefficient computing unit 7 computes a horizontal coefficient h for linear interpolation based on the position information (xq, yq) of the target pixel, which is transmitted from the position information computing unit 4. The vertical coefficient computing unit 8 computes a vertical coefficient v for linear interpolation based on the position information (xq, yq) of the target pixel, which is transmitted from the position information computing unit 4. The horizontal coefficient h computed by the horizontal coefficient computing unit 7 and the vertical coefficient v computed by the vertical coefficient computing unit 8 are transmitted to the linear interpolation circuit 9.

The linear interpolation circuit 9 computes a shift amount Vth(q) corresponding to the target pixel by performing a second-order linear interpolation process based on the correction parameters corresponding to the four areas near the target pixel, the vertical coefficient v, and the horizontal coefficient h. The computed shift amount Vth(q) corresponding to the target pixel is transmitted to the adder 2.

Figure 9:
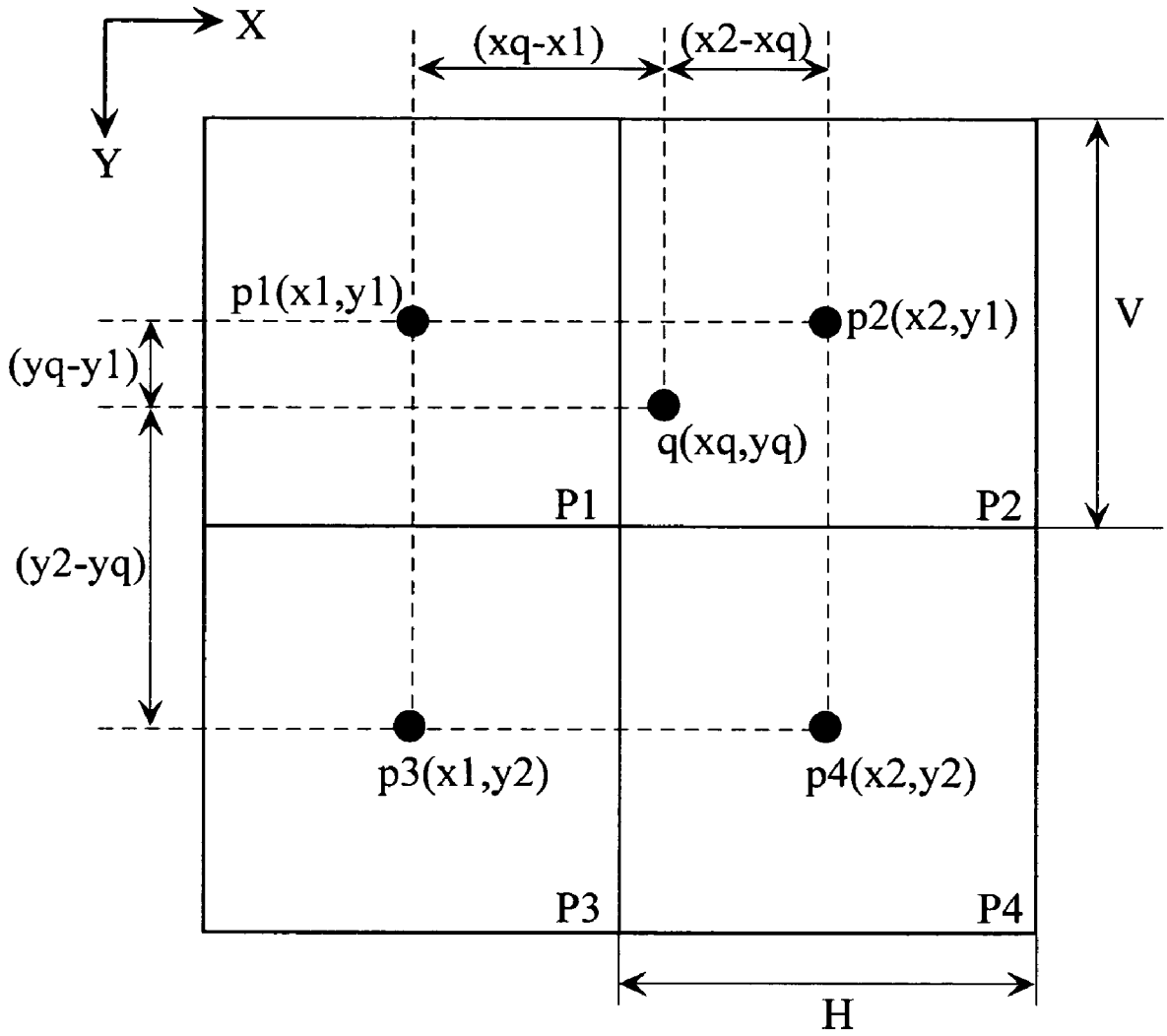
FIG. 9 is a schematic view for explaining a second-order linear interpolation process.

The second-order linear interpolation process will be described below. FIG. 9 shows a target pixel q and the four areas near the target pixel q. At this point, it is assumed that the four areas near the target pixel q are areas P1, P2, P3, and P4. It is assumed that a coordinate of the target pixel q is (xq, yq).

It is assumed that H is the number of pixels in a horizontal direction of the areas P1, P2, P3, and P4 and V is the number of pixels in a vertical direction. Further, assuming that (x1, y1) is the coordinate of a center pixel p1 of the area P1 and (x2, y2) is the coordinate of a center pixel p4 of the area P4, the coordinate of a center pixel p2 of the area P2 becomes (x2, y1) and the coordinate of a center pixel p3 of the area P3 becomes (x1, y2).

A distance in a horizontal direction between the target pixel q and the center pixel p1 of the area P1 becomes (xq−x1). A distance in the horizontal direction between the target pixel q and the center pixel p2 of the area P2 becomes (x2−xq). A distance in a vertical direction between the target pixel q and the center pixel p1 of the area P1 becomes (yq−y1). A distance in the vertical direction between the target pixel q and the center pixel p3 of the area P3 becomes (y2−yq).

The horizontal coefficient h is determined as h satisfying h:(1−h)=(xq−x1):(x2−xq). However, x2−x1=H. That is, the horizontal coefficient computing unit 7 computes the horizontal coefficient h based on the following formula (10).

[Formula (10)]

$$h=(xq-x1)/H \tag{10}$$

The vertical coefficient v is determined as v satisfying v:(1−v)=(yq−y1):(y2−yq). However, y2−y1=V. That is, the vertical coefficient computing unit 8 computes the vertical coefficient v based on the following formula (11).

[Formula (11)]

$$v=(yq-y1)/V \tag{11}$$

Assuming that Vth(p1), Vth(p2), Vth(p3), and Vth(p4) are the correction parameters corresponding to the areas P1 to P4, the vertical coefficient computing unit 8 computes the shift amount Vth(q) corresponding to the target pixel q based on the following formula (12).

[Formula (12)]

$$Vth(q)=(1-v)*T1+v*T2$$

$$T1=(1-h)*Vth(P1)+h*Vth(P2)$$

$$T2=(1-h)*Vth(P3)+h*Vth(P4) \tag{12}$$

The multiplier 1 multiplies the input video signal Yin by the gain. The output of the multiplier 1 is transmitted to the adder 2. The adder 2 adds the shift amount Vth(q) to the output of the multiplier 1. The output of the adder 2 is transmitted to DAC 3 and converted into an analog signal Yout, and the analog signal Yout is transmitted to the display panel.

According to the first embodiment, the brightness characteristic is equalized over the areas. When compared with the conventional art, the number of the parameters necessary for the correction can remarkably be decreased because the uneven display can be corrected only by the shift amount.

In the first embodiment, the correction parameter is computed in each area including the plural pixels. However, the correction parameter may be computed in each pixel. In this case, the horizontal coefficient computing unit 7, the vertical coefficient computing unit 8 and the linear interpolation circuit 9 are not necessary.

[4] Description of Modification of Correction Parameter Computing Method

In the correction parameter computing method described in [2], it is assumed that the light emission is started from the origin (input gradation level "0") in the input gradation level-brightness characteristic of the reference area. However, correction accuracy of the uneven display is decreased in the case where the light-emission starting point of the reference area is shifted from the origin.

Figure 10:
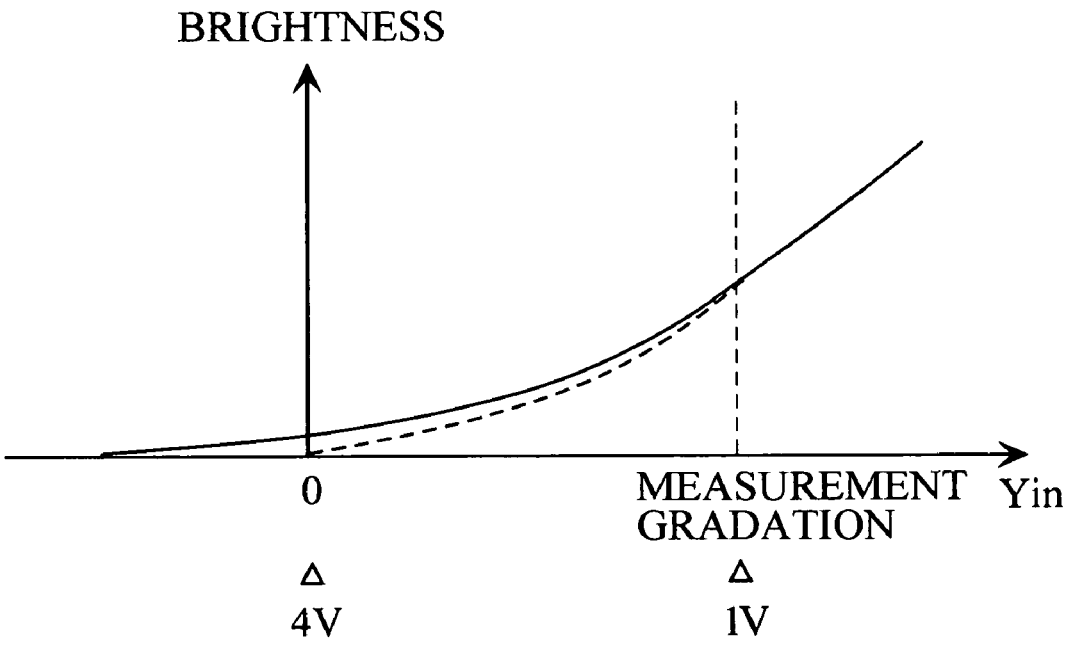
FIG. 10 is a graph showing a state in which a light-emission start point of a reference area is shifted from an origin.

For example, as shown by a solid line in FIG. 10, when the light-emission starting point of the reference area is shifted from the origin, the correction parameter computing method deals with the input gradation level-brightness characteristic of the reference area as if the light-emission characteristic curve of the reference area depicts the curve shown by a broken line of FIG. 10. Although actually it is necessary that the shift amount is computed for a solid line of FIG. 10, the shift amount is computed for the broken line of FIG. 10, which generates correction error.

Figure 11:
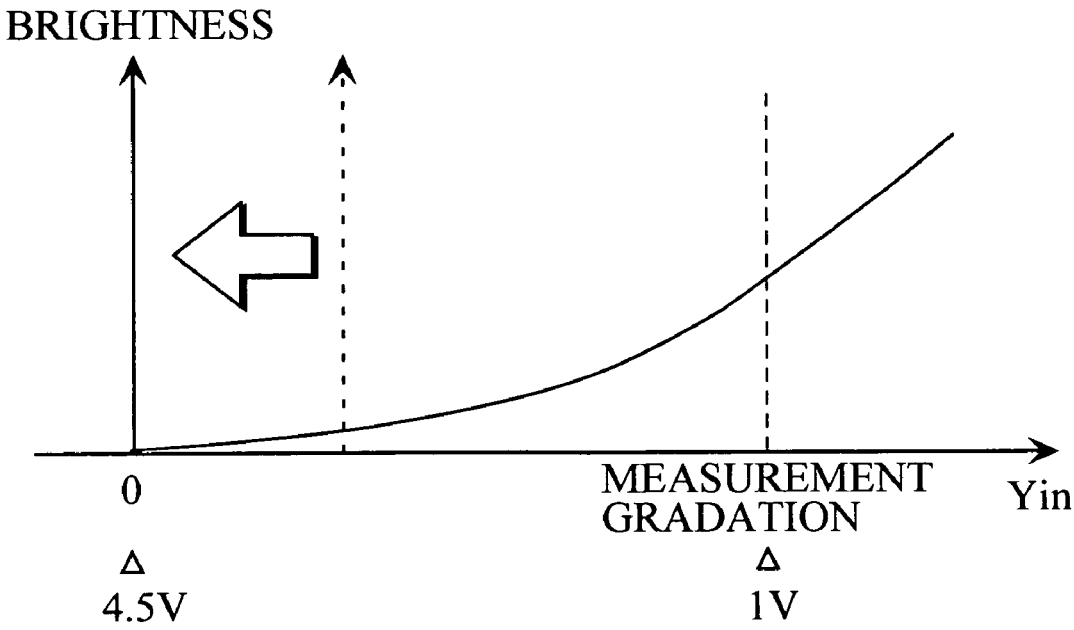
FIG. 11 is a graph showing a state in which reference voltage on a black side is adjusted such that light emission is started from Yin=0 when the light-emission start point of the reference area is shifted from the origin.

As shown in FIG. 11, in the case where the light-emission starting point of the reference area is shifted from the origin, a black-side reference voltage given to an analog-to-digital converter is adjusted such that the light emission is started from Yin=0. The black-side reference voltage means a value of applied voltage for the input of the signal level of 0. When the black-side reference voltage is 4V in FIG. 10, the characteristic shown in FIG. 11 is obtained by adjusting the black-side reference voltage at 4.5V.

In order to adjust the black-side reference voltage, it is necessary that, while the Yin value at a point where the light-emission characteristic curve of the reference area and the Yin axis intersect (hereinafter referred to as Bref) is determined, the correction parameter is computed in consideration of Bref. The correction parameter computing method taking into account Bref will be described below.

Figures 12, 13:
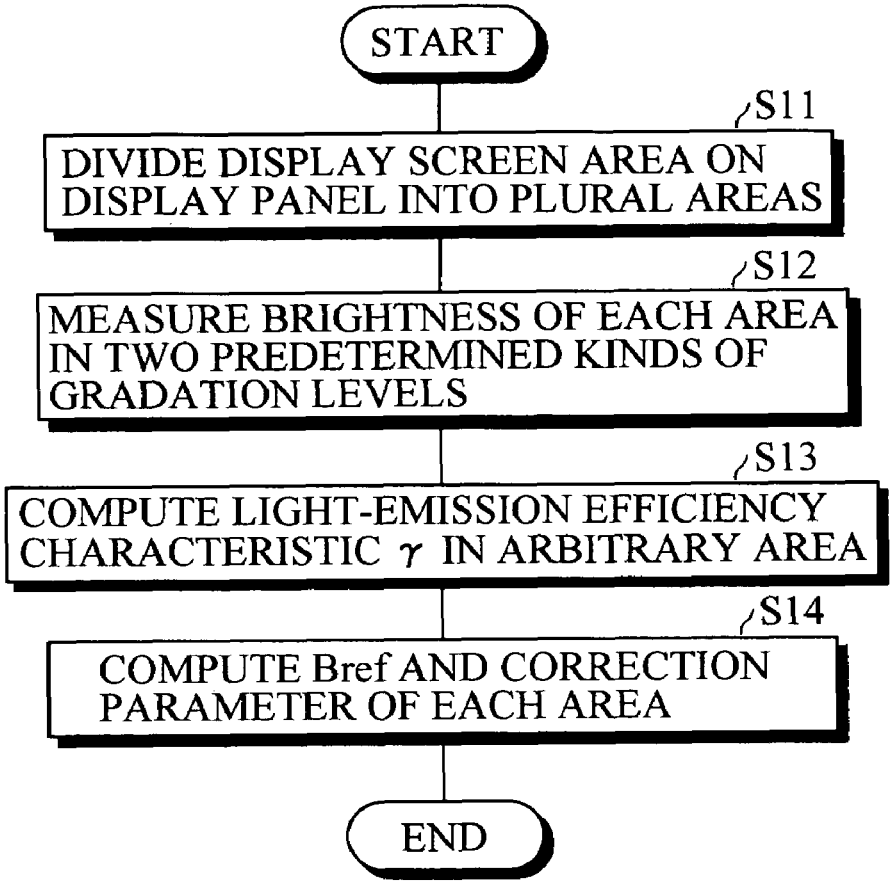
FIG. 12 is a flowchart showing the correction parameter computing procedure taking into account Bref.
FIG. 13 is a schematic view showing the measurement results of brightness levels $L_{AL}$ to $L_{FL}$ in the area A to F in 127 gradation levels and the measurement results of brightness levels $L_{AH}$ to $L_{FH}$ in the area A to F in 255 gradation levels.

FIG. 12 is a flowchart showing the correction parameter computing procedure taking into account Bref.

First the display screen area on the display panel is divided into the plural areas (Step S11). For example, as shown in FIG. 6, the display screen area on the display panel is divided into six areas A to F of 2×3.

Then, in the two kinds of the predetermined gradation levels (brightness measurement gradation levels: $I_L$ and $I_H$), the brightness of each of the areas A to F is measured (Step S12). For example, in the 127-gradation levels ($I_L$) and 255 gradation levels ($I_H$), the brightness of each of the areas A to F is measured.

In this example, it is assumed that the brightness measurement results $L_{AL}$ to $L_{FL}$ of the areas A to F give the values shown in FIG. 13A in the 127 gradation levels and the brightness measurement results $L_{AH}$ to $L_{FH}$ of the areas A to F give values shown in FIG. 13B in the 255 gradation levels. That is, $L_{AL}$=100, $L_{BL}$=80, $L_{CL}$=75, $L_{DL}$=95, $L_{EL}$=80, and $L_{FL}$=70, and $L_{AH}$=357, $L_{BH}$=286, $L_{CH}$=268, $L_{DH}$=339, $L_{EH}$=286, and $L_{FH}$=250. The brightest area is the area A, and the darkest area is the area F.

Then, in an arbitrary area, the light-emission efficiency characteristic γ is computed (Step S13). For example, the light-emission efficiency characteristic γ is computed in the area A. At this point, in the area A, the γ value may be computed by measuring the brightness in each plural gradation levels or the already-known γ value may be used.

Then, Bref and the correction parameter are computed in each of the areas A to F (Step S14).

When Bref, Vth(i), Data_Low(i), Data_High(i), $I_L$, $I_H$, and γ are defined as follows, Bref and the correction parameters of the areas A to F are computed based on the following formulas (13) and (14).

Bref: x intercept of light-emission characteristic curve in reference area ω

$I_L$ and $I_H$: brightness measurement gradation level

Vth(i): shift amount of area i from reference area ω (correction parameter)

Data_Low(i): measurement brightness of area i in brightness measurement gradation level $I_L$ Data_High(i): measurement brightness of area i at brightness measurement gradation level $I_H$ γ: light-emission efficiency characteristic (constant value) of display panel $$\text{Data_Low}(\omega) = \text{Data_High}(\omega) \times \left(\frac{I_L - Bref}{I_H - Bref}\right)^{\gamma} \tag{13}$$

$$\text{Data_Low}(i) = \text{Data_Low}(\omega) \times \left(\frac{I_L - Bref - Vth(i)}{I_L - Bref}\right)^{\gamma} \tag{14}$$

At this point, the brightest area A (area where measurement brightness is highest in the brightness measurement gradation level) is set at the reference area ω. Assuming that the reference area is area A, the number of brightness measurement gradation levels $I_L$ is "127," the number of brightness measurement gradation levels $I_H$ is "255," γ=2, and the measurement brightness of each of the areas A to F in the brightness measurement gradation levels $I_L$ and $I_H$ is the value shown in FIG. 13, the following formulas (15) holds from the above formula (13) in order to determine Bref.

$$100 = 357 \times \left(\frac{127 - Bref}{255 - Bref}\right)^2 \tag{15}$$

Figure 14:
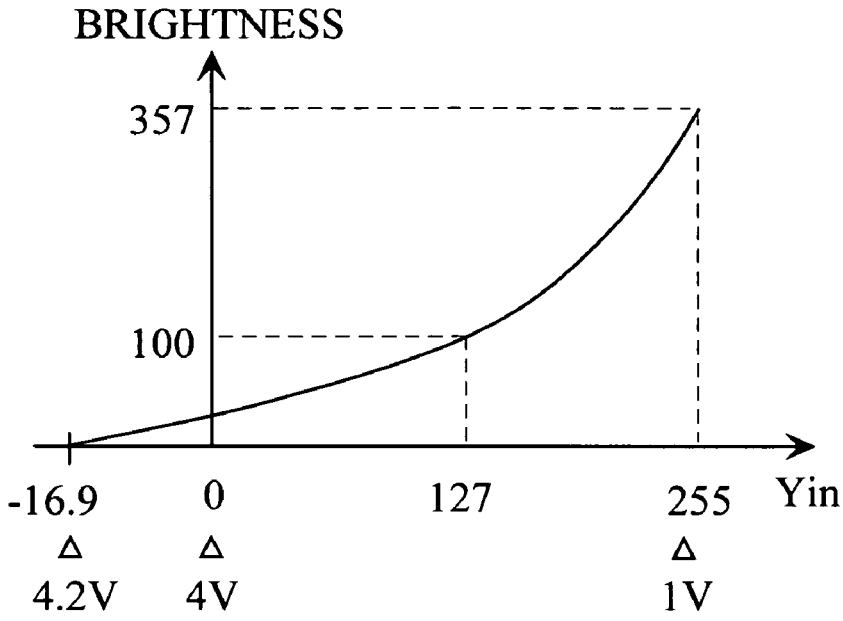
FIG. 14 is a graph showing a light-emission characteristic curve of a reference area A in the case of Bref=−16.9.

Therefore, Bref=−16.9. In this case, the light-emission characteristic curve of the reference area A is shown in FIG. 14. As can be seen from FIG. 14, when the black-side reference voltage is adjusted so as to be shifted leftward by 16.9 gradation levels, the light emission is started from the origin. When the 16.9 gradation levels are converted into the voltage value, for example the voltage value becomes 0.20V. Accordingly, the black-side reference voltage is set at the value as large as 0.20V.

Further, the following formulas (16) to (21) hold from the formula (14) for the areas A to F respectively.

$$100 = 100 \times \left(\frac{127 - (-16.9) - Vth(A)}{127 - (-16.9)}\right)^2 \tag{16}$$

$$80 = 100 \times \left(\frac{127 - (-16.9) - Vth(B)}{127 - (-16.9)}\right)^2 \tag{17}$$

$$75 = 100 \times \left(\frac{127 - (16.9) - Vth(C)}{127 - (-16.9)}\right)^2 \tag{18}$$

$$95 = 100 \times \left(\frac{127 - (-16.9) - Vth(D)}{127 - (16.9)}\right)^2 \tag{19}$$

$$80 = 100 \times \left(\frac{127 - (-16.9) - Vth(E)}{127 - (-16.9)}\right)^2 \tag{20}$$

$$70 = 100 \times \left(\frac{127 - (-16.9) - Vth(F)}{127 - (-16.9)}\right)^2 \tag{21}$$

The shift amounts Vth(i) of the areas A to F from the reference area A are computed based on the above formulas (16) to (21). The computation results are as follows:

Vth(A)=0
Vth(B)=15.2
Vth(C)=19.0
Vth(D)=3.6
Vth(E)=15.2
Vth(F)=23.5

[5] Description of Divided Area Setting Method Taking into Account Uneven Laser Annealing In the above [2], the display screen area on the display panel is divided into the plural areas to compute the correction parameter in each divided area. The divided area is determined here in consideration of uneven laser annealing.

In the process of producing the organic EL panel, the laser annealing is used in order to form polysilicon TFT. The laser annealing should mean that only an amorphous silicon film is instantaneously dissolved by laser irradiation to perform crystallization in order to form the polysilicon TFT through a low-temperature process in which melting and deformation of a glass substrate are not generated.

Figure 15:
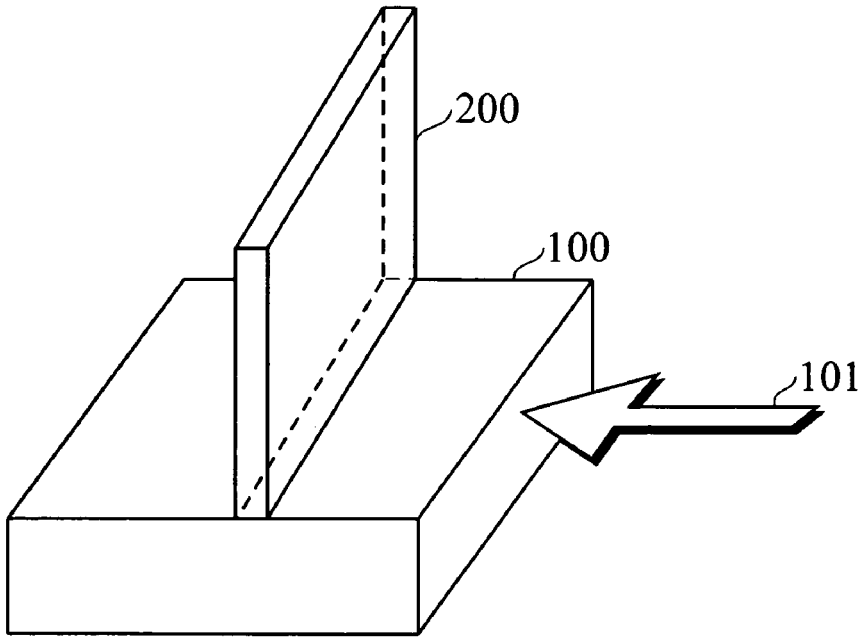
FIG. 15 is a schematic view for explaining a laser annealing process.

In performing the laser annealing, for example as shown in FIG. 15, the whole surface of a substrate 100 is irradiated in a pulsing manner with a slit-shaped laser beam 200. In order to irradiate the whole surface of the substrate 100 with the laser beam 200, the substrate 100 is irradiated with the pulsing laser beam 200 at each time when the substrate 100 is moved toward the direction of an arrow 101 in a step manner.

When the laser annealing is performed, not only the uneven laser annealing is generated on the substrate 100 in the moving direction of the substrate 100 (hereinafter referred to as laser annealing position moving direction), but also the uneven laser annealing is generated in the direction orthogonal to the moving direction of the substrate 100 (hereinafter referred to as direction orthogonal to laser annealing position moving direction).

Therefore, when the display screen area on the display panel is divided into the plural areas, the display screen area is divided into each unit area where the uneven laser annealing is generated. In this case, it is assumed that the direction (vertical direction of the display panel) orthogonal to the horizontal line of the display panel corresponds to the substrate moving direction (laser annealing position moving direction).

Figure 16A:
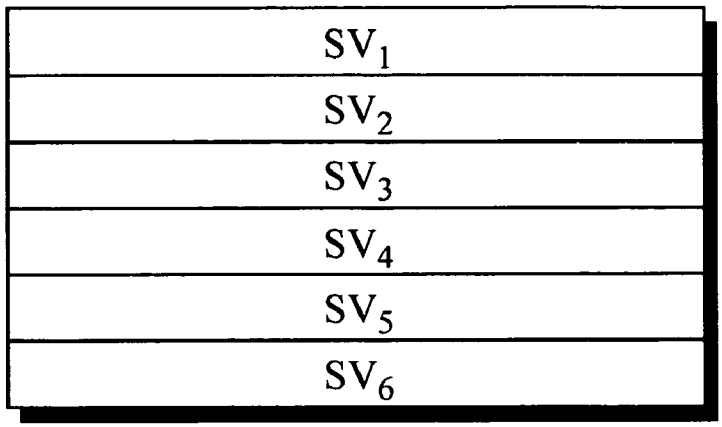
FIG. 16A to C are schematic views showing area dividing methods in consideration of uneven laser annealing.
Figure 16B:
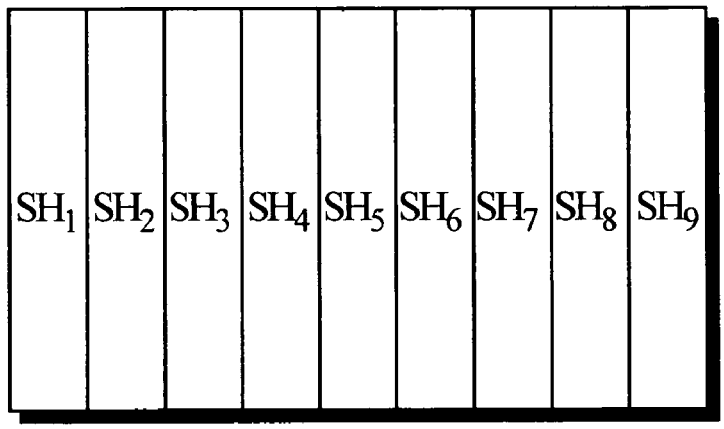

As shown in FIG. 16A, the display screen area is divided in each one or plural horizontal line width units in the vertical direction of the display panel (laser annealing position moving direction). It is assumed that the divided area is $SV_i$ (i=1, 2, . . . ). As shown in FIG. 16B, the display screen area is also divided in each one or plural vertical line width units in the horizontal direction of the display panel (direction orthogonal to laser annealing position moving direction). It is assumed that the divided area is $SH_i$ (i=1, 2, . . . ).

Figure 16C:
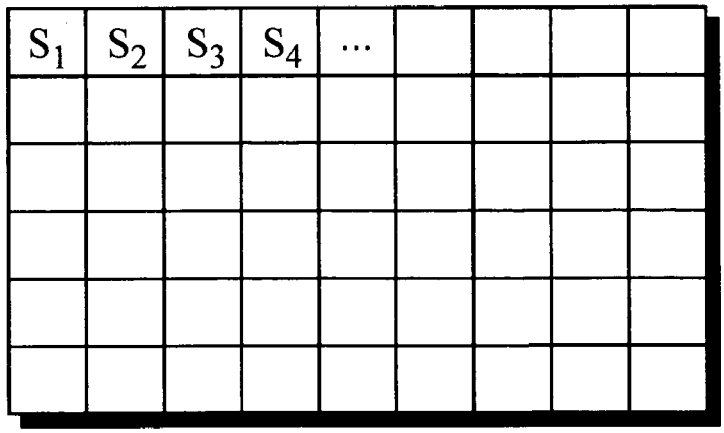

As shown in FIG. 16C, the final divided area $S_i$ (i=1, 2, . . . ) is set by combining the divided area $SV_i$ shown in FIG. 16A and the divided area $SH_i$ shown in FIG. 16B. The method of computing the correction parameter (shift amount) Vth(i) of each divided area $S_i$ will be described.

Figure 17:
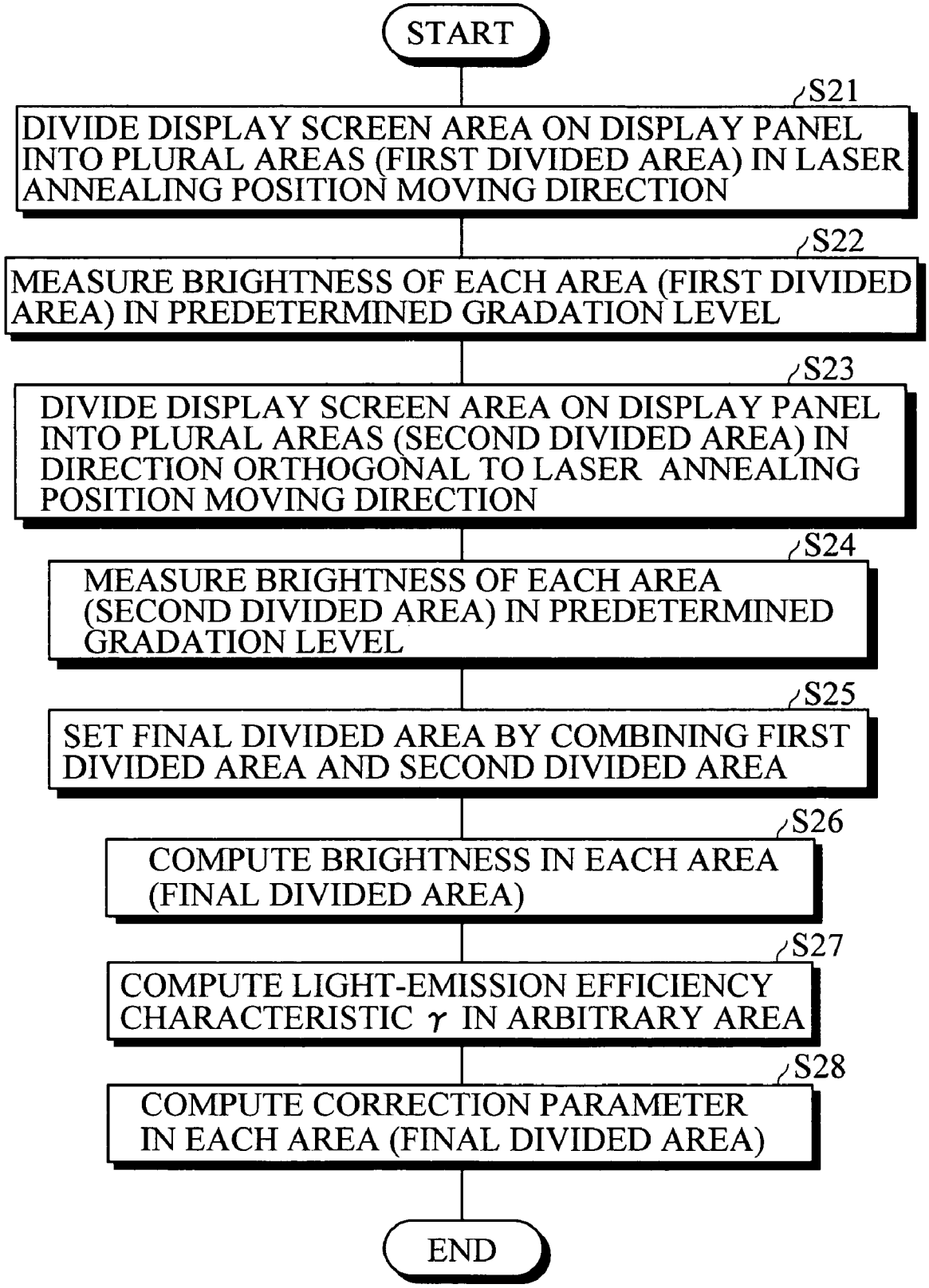
FIG. 17 is a flowchart showing the correction parameter computing procedure in each divided area $S_1$ of FIG. 16C.

FIG. 17 shows the correction parameter computing procedure in each divided area $S_i$.

First the display screen area on the display panel is divided into the plural areas in the laser annealing position moving direction (Step S21). In this example, as shown in FIG. 16A, the display screen area is divided in each one or plural horizontal line width units in the vertical direction of the display panel (laser annealing position moving direction). The divided area is referred to as a first divided area. It is assumed that the first divided area is $SV_i$ (i=1, 2, . . . ).

In the predetermined gradation level (hereinafter referred to as brightness measurement gradation level, and set at "127" here), the brightness of each of the areas $SV_i$ is measured (Step S22). For example, the brightness for the area $SV_i$ is determined as follows: The whole current passing through the display panel is measured while only the area $SV_i$ is lit at the brightness measurement gradation level, and the measurement result is divided by an area of the area $SV_i$ (the total number of the pixels in the area $SV_i$).

Then, the display screen area on the display panel is divided into the plural areas in the direction orthogonal to the laser annealing position moving direction (Step S23). In this example, as shown in FIG. 16B, the display screen area is divided in each one or plural vertical line width units in the horizontal direction of the display panel (laser annealing position moving direction). The divided area is referred to as a second divided area. It is assumed that the second divided area is $SH_i$ (i=1, 2, . . . ).

In the predetermined gradation level (hereinafter referred to as brightness measurement gradation level, and set at "127" here), the brightness of each of the areas $SH_i$ is measured (Step S24). For example, the brightness for the area $SH_i$ is determined as follows: The whole current passing through the display panel is measured while only the area $SH_i$ is lit at the brightness measurement gradation level, and the measurement result is divided by an area of the area $SH_i$ (the total number of the pixels in the area $SH_i$).

Then, as shown in FIG. 16C, the final divided area $S_i$ (i=1, 2, . . . ) is set by combining the first divided area $SV_i$ obtained in Step S21 and the second divided area $SH_i$ obtained in Step S23 (Step S25).

The brightness of the divided area $S_i$ is computed based on the brightness of the first divided area $SV_i$ and the brightness of the second divided area $SH_i$ (Step S26). That is, the brightness of the final divided area $S_i$ is determined by averaging the brightness of the first divided area $SV_i$ and the brightness of the second divided area $SH_i$. Alternatively, the brightness of the final divided area $S_i$ may be determined by adding the brightness of the first divided area $SV_i$ including the area and the brightness of the second divided area $SH_i$ including the area.

Then, the light-emission efficiency characteristic γ is computed in an arbitrary area (reference area) of the area $S_i$ (Step S27). The method of computing the light-emission efficiency characteristic γ is similar to Step S3 of FIG. 5.

Then, the correction parameter is computed in each of the area $S_i$ (Step S28). The method of computing the correction parameter is similar to Step S4 of FIG. 5.

As with the method described in FIG. 8, the uneven display correction is performed by using the correction parameter of each area $S_i$ obtained by the above-described manner.

The display screen area may be divided only in the laser annealing position moving direction and the divided area obtained may be set at the unit area.

[B] Description of Second Embodiment

[1] Description of Basic Concept of Second Embodiment

In the first embodiment, it is assumed that the light-emission efficiency characteristics themselves are equal to one another among the pixels in the display panel, and the input video signal level brightness characteristic of one of two pixels is horizontally shifted by the value according to the difference ΔVth in light-emission start gradation level Vth between the pixels. However, as shown in FIG. 18, sometimes the light-emission efficiency characteristics themselves differ from one another among the pixels in the display panel due to the various causes.

Figure 18:
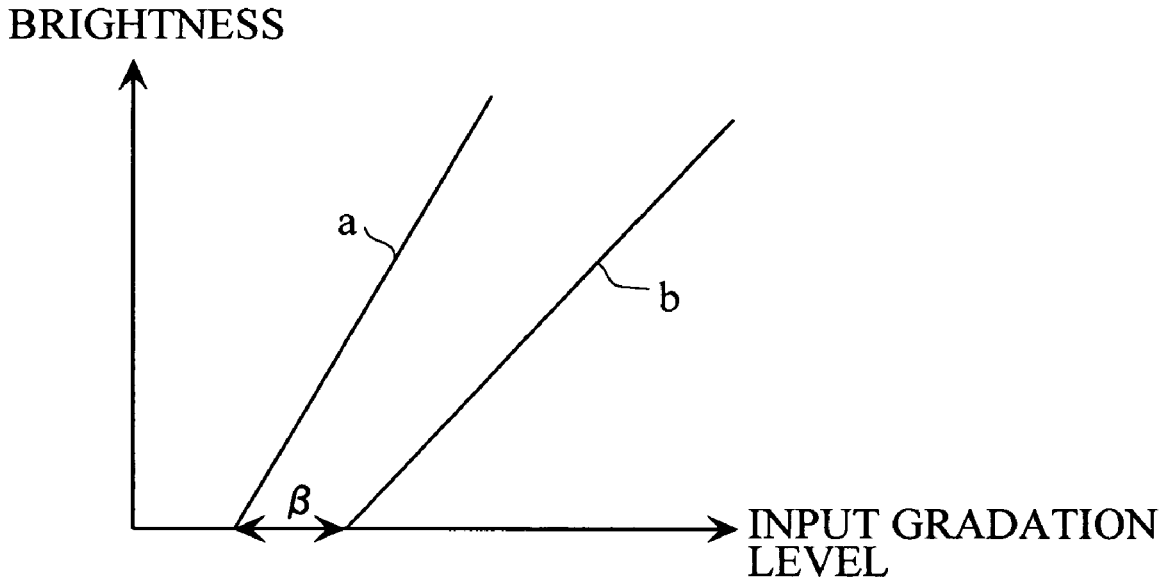
FIG. 18 is a graph showing the input gradation level-brightness characteristics of the pixels a and b whose display panels differ from each other.

FIG. 18 shows input gradation level-brightness characteristics of the pixels a and b whose display panels differ from each other. In this case, for the sake of convenience, the input gradation level-brightness characteristics are expressed by the line, however, actually the input gradation level-brightness characteristics are given as the curve.

In FIG. 18, when the shift amounts are set constant in all the gradation levels, the input video signal level brightness characteristics of the pixels a and b are not equalized to each other.

Therefore, in the second embodiment, not the same shift amount is set at all the input gradation levels, but the shift amount is adjusted depending on the input gradation levels. Specifically there are two cases, namely, the case in which the shift amount is increased as the input gradation level is increased and the case in which the shift amount is increased as the input gradation level is decreased.

As shown in FIG. 6, assuming that the display screen area on the display panel is divided into the plural areas A to F and the input gradation is expressed by eight bits, the shift amount Vth(i) of a certain area i is described by the following formula (22).

[Formula (22)]

$$Vth(i)=\{\alpha\times(Yin/255)+\beta \quad (22)$$

Where, Yin is the input video signal, α is a first correction parameter, and β is a second correction parameter which corresponds to the shift amount (difference ΔVth in light-emission start gradation level) when the input gradation is zero as shown in FIG. 18.

Figure 19:
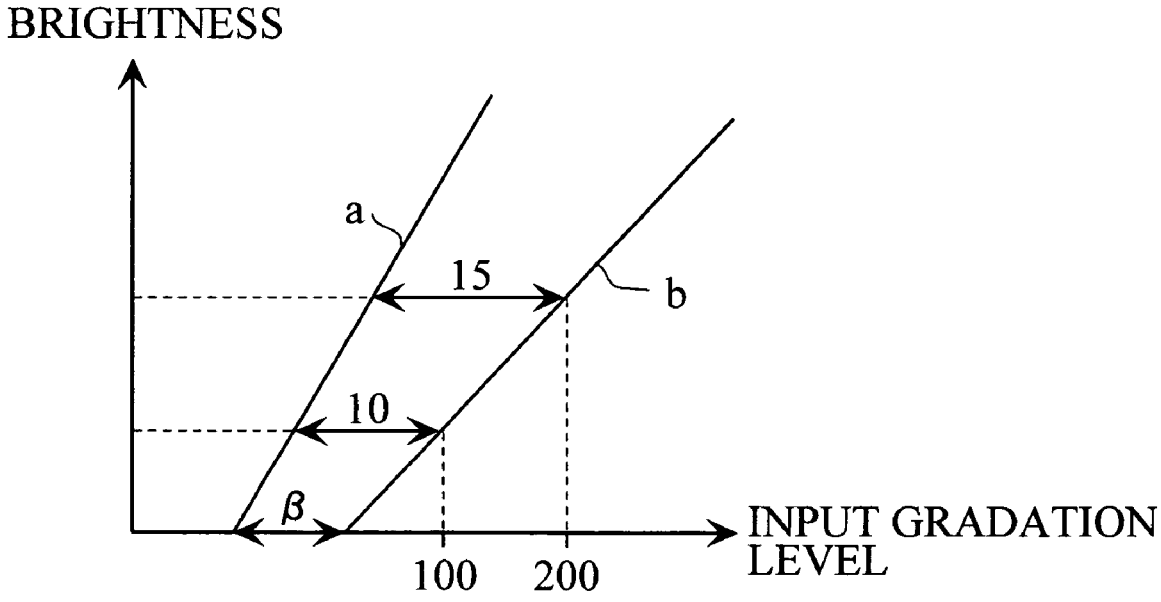
FIG. 19 is a graph showing computed shift amounts Vth1 and Vth2 in two input video signals Yin1 and Yin2 (100 and 200 in this example)

A concept of the method of computing the correction parameters α and β will be described. As shown in FIGS. 18 and 19, it is assumed that the input video signal level brightness characteristics of the pixels a and b are equalized to each other by shifting the input gradation level brightness characteristic of the pixel b.

As shown in FIG. 19, in two input video signals Yin1 and Yin2 (100 and 200 in this example), the shift amounts Vth1 and Vth2 are computed by the same technique as for the first embodiment. In FIG. 19, Vth1=10 and Vth2=15. When Yin1, Yin2, Vth1, and Vth2 are substituted in the above formula (22), simultaneous equations shown by the following formula (23) are obtained.

[Formula (23)]

$$10=\{\alpha\times(100/255)+\beta$$

$$15=\{\alpha\times(200/255)+\beta \quad (23)$$

The correction parameters α and β for the pixel b are obtained by solving the simultaneous equations. In this case, α=12.75 and β=5.

Figure 20:
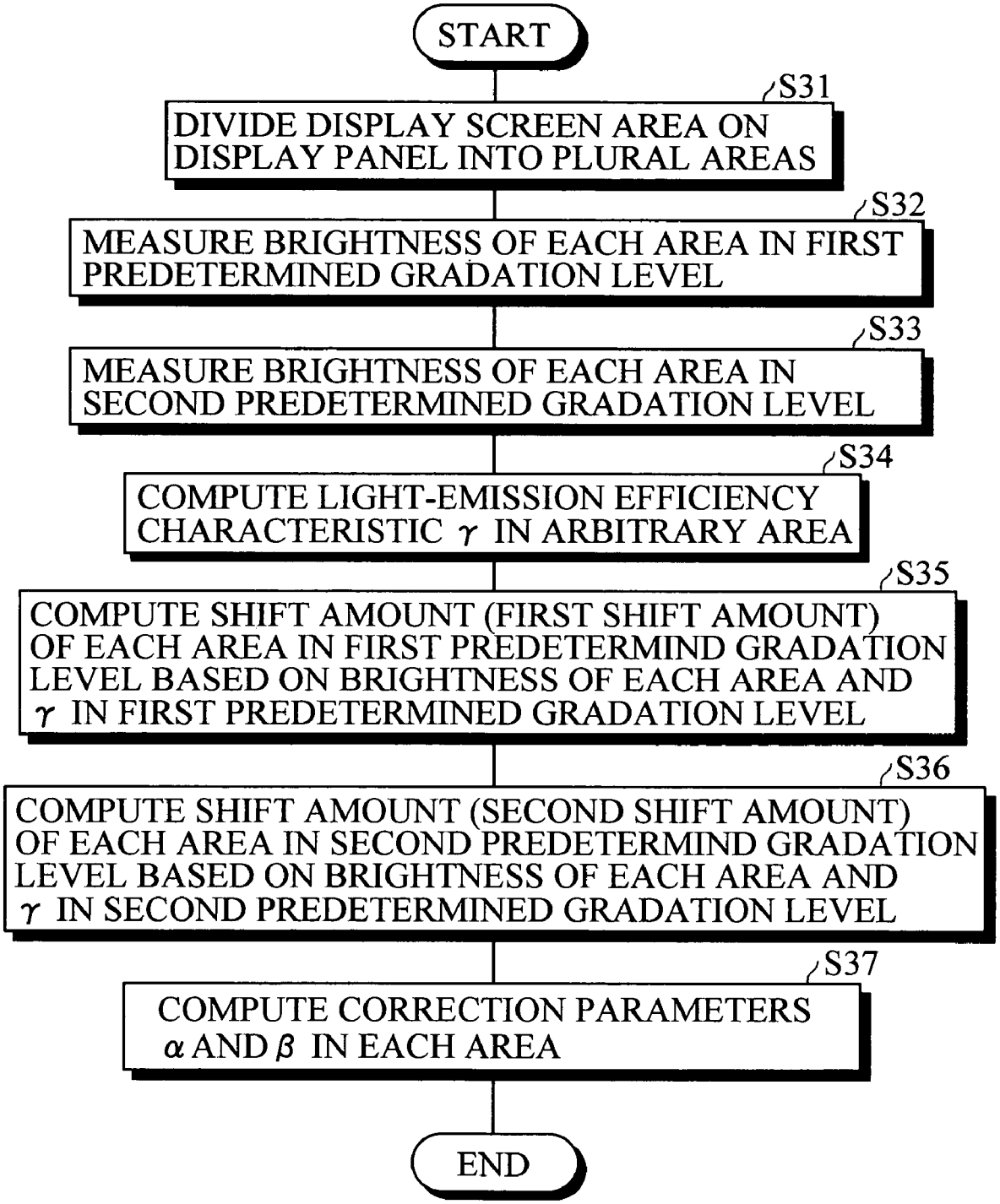
FIG. 20 is a flowchart showing the correction parameter computing procedure in each area.

[2] Description of Method of Computing Correction Parameters α and β in Each Area FIG. 20 shows procedure of computing the correction parameters in each area.

First the display screen area on the display panel is divided into the plural areas (Step S31). For example, as shown in FIG. 6, the display screen area on the display panel is divided into six areas A to F of 2×3.

Then, in a first predetermined gradation level (hereinafter referred to as first brightness measurement gradation level, and for example set at "100"), the brightness of each of the areas A to F is measured (Step S32).

Then, in a second predetermined gradation level (hereinafter referred to as second brightness measurement gradation level, and for example set at "200"), the brightness of each of the areas A to F is measured (Step S33).

In an arbitrary area in the areas A to F, the light-emission efficiency characteristic γ is computed (Step S34). For example the light-emission efficiency characteristic γ is computed in the area A.

The shift amounts (first shift amounts) Vth1(A) to Vth1(F) of the area A to F are computed in the first brightness measurement gradation level based on the brightness of each of the areas A to F in the first brightness measurement gradation level and the light-emission efficiency characteristic γ of the area A (Step S35). The brightness of each of the areas A to F is obtained in Step S32 and the light-emission efficiency characteristic γ is computed in Step S34. The method of computing the first shift amount Vth1 is similar to Step S4 of FIG. 5.

Then, the shift amounts (second shift amounts) Vth2(A) to Vth2(F) of the area A to F are computed in the second brightness measurement gradation level based on the brightness of each of the areas A to F in the second brightness measurement gradation level and the light-emission efficiency characteristic γ of the area A (Step S36). The brightness of each of the areas A to F is obtained in Step S33 and the light-emission efficiency characteristic γ is computed in Step S34. The method of computing the second shift amount Vth2 is similar to Step S4 of FIG. 5.

Then, the correction parameters α(A) to α(F) and β(A) to β(F) are computed in the areas A to F based on the first shift amounts Vth1(A) to Vth1(F) of the of the areas A to F, computed in Step S 35, and the second shift amounts Vth2(A) to Vth2(F) of the of the areas A to F, computed in Step S 36 (Step S37). For example, correction parameters α(A) and β(A) for the area A are computed based on the first and second shift amounts Vth1(A) and Vth2(A) for the area A and the above formula (22).

[3] Description of Uneven Display Correction Circuit

Figure 21:
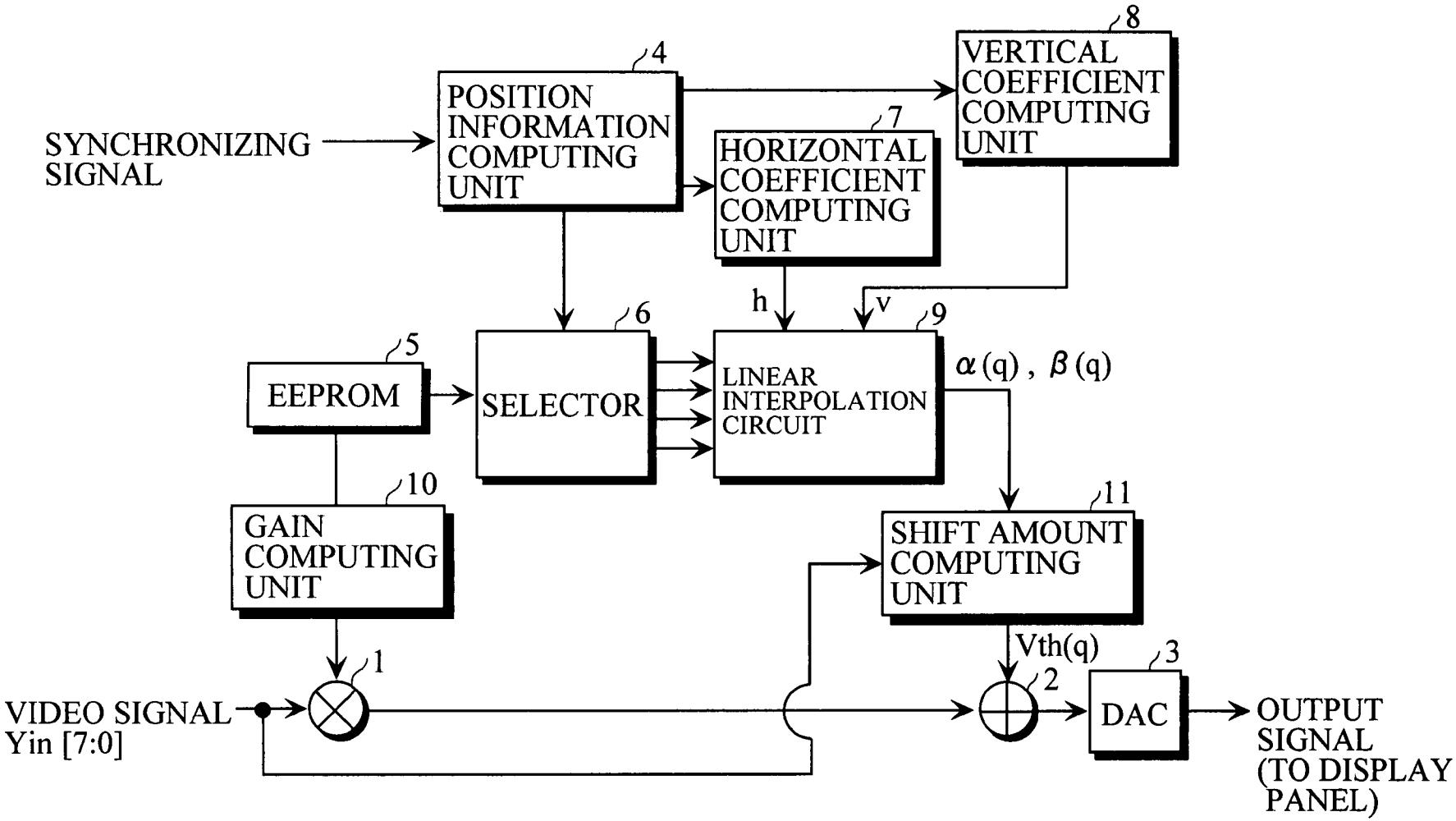
FIG. 21 is a block diagram showing the configuration of the uneven display correction circuit.

FIG. 21 shows the configuration of an uneven display correction circuit. In FIG. 21, the same component as for FIG. 8 is indicated by the same reference numeral.

The correction parameters α(A) to α(F) and β(A) to β(F) of the areas A to F are stored in EEPROM 5. A maximum value $Vth_{MAX}$ of the shift amount [Vth(i)={α×(Yin/255}+β] in all the area and all the gradation levels is also stored in EEPROM 5.

The input video signal Yin is transmitted to the display panel (organic EL panel) through the multiplier 1, the adder 2, and DAC 3. The multiplier 1 performs the process of changing the step width of the input video signal. The adder 2 performs the shift process to the output of the multiplier 1. DAC 3 converts the output of the adder 2 into an analog signal.

The maximum value $Vth_{MAX}$ of the shift amount is transmitted from EEPROM 5 to the gain computing unit 10. The gain computing unit 10 computes the gain based on the following formula (24), and the gain computing unit 10 provides the computed gain to the multiplier 1.

$$\text{gain} = \frac{255 - Vth_{MAX}}{255} \quad (24)$$

The synchronizing signal included in the input video signal is transmitted to the position information computing unit 4. The position information computing unit 4 computes the position information (xq, yq) of the currently inputted video signal (video signal of target signal) based on the synchronizing signal.

The position information (xq, yq) of the target pixel, which is computed by the position information computing unit 4, is transmitted to the selector 6, the horizontal coefficient computing unit 7, and the vertical coefficient computing unit 8. The correction parameters α(A) to α(F) and β(A) to β(F) corresponding to the areas A to F are inputted from EEPROM 5 to the selector 6. The selector 6 outputs the correction parameters α and β corresponding to the four areas near the target pixel based on the position information (xq, yq) of the target pixel, which is transmitted from the position information computing unit 4. The correction parameters α and β corresponding to the four areas, which are outputted from the selector 6, are transmitted to the linear interpolation circuit 9.

The horizontal coefficient computing unit 7 computes the horizontal coefficient h for linear interpolation based on the position information (xq, yq) of the target pixel, which is transmitted from the position information computing unit 4. The vertical coefficient computing unit 8 computes the vertical coefficient v for linear interpolation based on the position information (xq, yq) of the target pixel, which is transmitted from the position information computing unit 4. The horizontal coefficient h computed by the horizontal coefficient computing unit 7 and the vertical coefficient v computed by the vertical coefficient computing unit 8 are transmitted to the linear interpolation circuit 9.

The linear interpolation circuit 9 computes correction parameters α(q) and β(q) corresponding to the target pixel by performing the second-order linear interpolation process based on the correction parameters α and β corresponding to the four areas near the target pixel, the vertical coefficient v, and the horizontal coefficient h. In the second embodiment, the correction parameters α(q) and β(q) corresponding to the target pixel are computed by the second-order linear interpolation process, and the second-order linear interpolation process is similar to the first embodiment. The correction parameters $\alpha(q)$ and $\beta(q)$ corresponding to the target pixel, which are computed by the linear interpolation circuit 9, are transmitted to a shift amount computing unit 11.

While the input video signal Yin is transmitted to the multiplier 1, the input video signal Yin is transmitted to the shift amount computing unit 11. The shift amount computing unit 11 computes the shift amount Vth(q) corresponding to the target pixel and according to the input video signal level by substituting the input video signal Yin and the correction parameters $\alpha(q)$ and $\beta(q)$ in the above formula (22). The correction parameters $\alpha(q)$ and $\beta(q)$ corresponding to the target pixel are given from the linear interpolation circuit 9. The shift amount Vth(q) computed by the shift amount computing unit 11 is transmitted to the adder 2.

The multiplier 1 multiplies the gain, given by the gain computing unit 10, by the input video signal Yin. The output of the multiplier 1 is transmitted to the adder 2. The adder 2 adds the shift amount Vth(q) to the output of the multiplier 1. The output of the adder 2 is transmitted to DAC 3 and converted into the analog signal Yout, and the analog signal is transmitted to the display panel.

The invention claimed is:

1. An uneven display correction method, characterized by including:

a first step of dividing a display area of a display panel into a plurality of unit areas, setting one arbitrary unit area among the unit areas at a reference area, and using a previously determined value as a correction parameter in each unit area, the value corresponding to a difference between a light-emission start gradation level of the unit area and the light-emission start gradation level of the reference area; and a second step of correcting an input video signal based on the correction parameter determined in each unit area, wherein the first step includes:

a) measuring brightness of each unit area in one predetermined gradation level;

b) determining a light-emission efficiency characteristic in an arbitrary unit area; and c) computing the value as the correction parameter in each unit area by setting one arbitrary unit area among the unit areas at the reference area based on the brightness measured in each unit area in the step a) and the light-emission efficiency characteristic determined in the step b), the value corresponding to the difference between the light-emission start gradation level of the unit area and the light-emission start gradation level of the reference area.

2. An uneven display correction method according to claim 1, characterized in that the brightness of each unit area is measured with a surface brightness measuring apparatus in the step a).

3. An uneven display correction method according to claim 1, characterized in that the brightness of each unit area is measured by measuring current passing through the display panel in the step a).

4. An uneven display correction method according to claim 1, characterized in that each unit area is an area of one pixel unit.

5. An uneven display correction method according to claim 1, characterized in that each unit area is an area having a predetermined size including a plurality of pixels.

6. An uneven display correction method according to claim 5, characterized in that each unit area is a divided area which is obtained by dividing the display area of the display panel into a plurality of display areas in a laser annealing position moving direction during a display panel producing process.

7. An uneven display correction method according to claim 5, characterized in that each unit area is a divided area which is obtained by dividing the display area of the display panel into the plurality of display areas in a direction orthogonal to the laser annealing position moving direction while dividing the display area of the display panel into the plurality of display areas in the laser annealing position moving direction during the display panel producing process.

8. An uneven display correction method according to claim 4, characterized in that the second step corrects the input video signal based on the correction parameter according to a pixel position of the input video signal.

9. An uneven display correction method as in any one of claims 5 to 7, characterized in that the second step includes:

a step of determining the correction parameter according to the pixel position of the input video signal by performing second-order linear interpolation on the correction parameters of four unit areas near the pixel position of the input video signal; and a step of correcting the input video signal based on the correction parameter according to the pixel position of the input video signal.

10. An uneven display correction method according to claim 1, characterized in that the unit area corresponding to the highest brightness is determined as a reference unit area in the brightness measured in the step a), and the uneven display correction method includes a fourth step of allocating the number of input video signal levels to the number of gradation levels in which a correction parameter maximum value is subtracted from the whole number of gradation levels while the correction parameter determined in the step c) is set at the correction parameter maximum value for the unit area corresponding to the lowest brightness in the brightness measured in the step a), and the second step is performed after the fourth step.

11. An uneven display correction method, characterized by including:

a first step of dividing a display area of a display panel into a plurality of unit areas, setting one arbitrary unit area among the unit areas at a reference area, and using a previously determined value as a correction parameter in each unit area, the value corresponding to a difference between a light-emission start gradation level of the unit area and the light-emission start gradation level of the reference area; and a second step of correcting an input video signal based on the correction parameter determined in each unit area, wherein the first step includes:

a step of determining an adjustment value for adjusting a black reference voltage such that the light-emission start gradation level of the reference area becomes a zero level except that the light-emission start gradation level is the zero level; and a step of substituting the using of a previously determining value as the correction parameter in each unit area after the light-emission start gradation level of the unit area for the light-emission start gradation level of the unit area of the post-black reference voltage adjustment, the value corresponding to a difference between the light-emission start gradation level of the unit area and the light-emission start gradation level of the reference area.

12. An uneven display correction method according to claim 11, characterized in that the first step includes:

a) measuring brightness of each unit area in two predetermined gradation levels different from each other;

b) determining a light-emission efficiency characteristic in an arbitrary unit area;

c) setting one arbitrary unit area in the unit areas as a reference area, the and determining an adjustment value for adjusting the black reference voltage such that the light-emission start gradation level of the reference area becomes a zero level based on two values of the brightness and the light-emission efficiency characteristic, the two values of the brightness being measured in two gradation levels previously determined with respect to the reference area in the step a), the light-emission efficiency characteristic being determined in the step b); and d) computing a value as the correction parameter in each unit area based on the brightness measured in each unit area in the step a), the light-emission efficiency characteristic determined in the step b), and the adjustment value determined in the step c), the value corresponding to the difference between the light-emission start gradation level of the unit area and the light-emission start gradation level of the reference area.

13. An uneven display correction method according to claim 12, characterized in that the unit area corresponding to the highest brightness is determined as a reference unit area in the brightness measured in the step a), and the uneven display correction method includes a fifth step of allocating the number of input video signal levels to the number of gradation levels in which a correction parameter maximum value is subtracted from the whole number of gradation levels while the correction parameter determined in the step d) is set at the correction parameter maximum value for the unit area corresponding to the lowest brightness in the brightness measured in the step a), and the second step is performed after the fifth step.

14. An uneven display correction method, characterized by including:

a first step of dividing a display area of a display panel into a plurality of unit areas, the setting one arbitrary unit area among the unit areas as reference area, and using a previously determined correction parameter for approximately calculating a difference in input video signal for the same brightness between a light-emission efficiency characteristic for each input video signal level in the unit area and the light-mission efficiency characteristic for each input video signal level in the reference area in each unit area, with the use of the input video signal level as a variable; and a second step of correcting an input video signal based on the correction parameter determined in each unit area.

15. An uneven display correction method according to claim 14, characterized in that the first step includes:

a) measuring brightness of each unit area in a first predetermined gradation level;

b) measuring brightness of each unit area in a second predetermined gradation level;

c) determining a light-emission efficiency characteristic in an arbitrary unit area;

d) computing the difference in input video signal for the same brightness between the light-emission efficiency characteristic for each input video signal level in the unit area and the light-emission efficiency characteristic for each input video signal level in the reference area at the first gradation level in each unit area by setting one arbitrary unit area among the unit areas at a reference area based on the brightness measured in each unit area in the step a) and the light-emission efficiency characteristic determined in the step c);

e) computing the difference in input video signal for the same brightness between the light-emission efficiency characteristic for each input video signal level in the unit area and the light-emission efficiency characteristic for each input video signal level in the reference area at the second gradation level in each unit area by setting one arbitrary unit area among the unit areas at a reference area based on the brightness measured in each unit area in the step b) and the light-emission efficiency characteristic determined in the step c); and f) determining the correction parameter based on the difference determined in each unit area in the step d) and the difference determined in each unit area in the step e).

16. An uneven display correction method according to claims 14 or 15, characterized in that the correction parameters are $\alpha$ and $\beta$ given by the following formula:

$$Vth=(\alpha\times Yin/Ymax)+\beta,$$

where

Yin: input video signal level,

Ymax: maximum value of signal level in scope of input video signal, and

Vth: approximate value of difference in input video signal for the same brightness between light-emission brightness characteristics for each input video signal level in a certain unit area and for each input video signal level in reference area when input video signal level exists at Yin.

* * * * *